United States Patent [19]

Ikei et al.

[11] 4,377,617

[45] Mar. 22, 1983

[54] LOUDSPEAKER DIAPHRAGM AND PROCESS FOR PRODUCING SAME

[75] Inventors: Akira Ikei, Yawata; Motoharu Akahama, Hirakata; Tokisuke Wada, Uji; Takashi Onogi, Takarazuka, all of Japan

[73] Assignee: Onkyo Kabushiki Kaisha, Osaka, Japan

[21] Appl. No.: 326,446

[22] Filed: Dec. 2, 1981

[30] Foreign Application Priority Data

Dec. 3, 1980 [JP] Japan ..... 55-171153

[51] Int. Cl.[3] ..... G10K 13/00; H04R 7/00

[52] U.S. Cl. ..... 428/214; 181/167; 181/169; 181/170; 156/306.6; 156/307.3; 156/331.7; 428/246; 428/286; 428/287; 428/423.3; 428/423.7; 428/425.3

[58] Field of Search ..... 181/167, 169, 170; 156/306.6, 307.3, 331.7; 428/213, 214, 246, 286, 287, 423.3, 423.7, 425.3

[56] References Cited

U.S. PATENT DOCUMENTS

| | | | |
|---|---|---|---|
| 2,976,202 | 3/1961 | Salem et al. | 428/425.3 |
| 4,116,741 | 9/1978 | Thoma et al. | 428/423.3 |
| 4,140,203 | 2/1979 | Niguchi et al. | 181/167 |

*Primary Examiner*—William J. Van Balen

*Attorney, Agent, or Firm*—Edwin E. Greigg

[57] ABSTRACT

A dome-shaped diaphragm for loudspeakers comprising a substrate fabric of synthetic fiber, a poly-urethane elastomer film for giving airtightness to the substrate fabric, and a viscoelastic resin adhesive adhering the fabric and the film together.

10 Claims, 5 Drawing Figures

9
10
11
12
13
14
15
16
17
18
19
20
21A
21B

LOUDSPEAKER DIAPHRAGM AND PROCESS FOR PRODUCING SAME

BACKGROUND OF THE INVENTION

1. Field of the Invention

The present invention relates to a dome-shaped diaphragm for loudspeakers and to a process for producing the diaphragm.

2. Description of the Prior Art

Conventionally dome-shaped diaphragms for loud speakers are produced chiefly by the following two methods in order to give the substrate of the diaphragm shape retentivity and airtightness.

When a substrate fabric of synthetic fiber is used for the first method, the substrate fabric is shaped to the form of a dome with application of heat to cause the fabric to retain the shape by utilizing the thermoplastic properties of the synthetic fiber itself. To assure higher shape retentivity, it is also practice to immerse the substrate fabric in a solution of phenolic resin and thereby utilize the thermosetting properties of the resin. Alternatively when a substrate fabric of natural fiber is used, it is critical to utilize the setting properties of such phenolic resin in affording the shape retentivity. The substrate fabric is rendered airtight, for example, by coating the substrate fabric with an emulsion of acrylate.

Since the first method forms a coating of resin emulsion to obtain airtightness, the method involves difficulty in giving a uniform thickness to the diaphragm, consequently failing to impart uniform elasticity to the diaphragm and permitting marked partial resonance in the range of pertial vibration. Further if the substrate fabric of natural fiber has large meshes or openings, the resin solution is likely to ooze from the rear side of the fabric, so that there is the need to use a thick substrate fabric of compact structure. This entails the drawback of adding to the weight of the diaphragm and resulting in a reduced acoustic radiation efficiency. Additionally it is impossible to coat the substrate fabric to a thickness larger than its thickness, and there is a limitation on the thickness of the coating.

Another method has been provided to overcome such drawbacks of the coating method, as disclosed, for example, in U.S. Pat. No. 4,140,203, wherein a polyurethane elastomer film is joined to a substrate fabric of natural or synthetic fiber with application of heat and pressure. Since the film to be joined has a uniform thickness, the second method is free of the foregoing drawbacks of the coating method.

To be sure, the second method joins the substrate fabric and the film together with heat and pressure, but the assembly, even if obtained under an increased pressure, is apparently composed of two layers and therefore has the drawback that when it is vibrated, the assembly is unable to permit continuous, smooth and proper propagation of the vibration across the junction of the substrate fabric and the film.

FIG. 4 shows the acoustic characteristics determined by an experiment for a loudspeaker diaphragm prepared by the second method described above. In this drawing, A represents sound pressure and B second harmonics. The second harmonics B exhibit 70 dB at 900 Hz, indicating pronounced distortion of sound due to partial vibration.

We conducted various experiments and found that this drawback of the prior art was attributable to the fact that the substrate fabric and the polyurethane elastomer film were directly joined together with heat and pressure to form an assembly of two layers.

Accordingly, instead of thermally joining the substrate fabric and the polyurethane elastomer film together under pressure, we attempted to adhere the fabric and the film together with an adhesive, for example, with epoxy resin.

FIG. 5 shows the acoustic characteristics determined by an experiment for a loudspeaker diaphragm which was prepared from a substrate fabric of synthetic fiber and a polyurethane elastomer film by joining them together with the adhesive.

The drawing shows that although sound pressure A′ almost resembles that shown in FIG. 4, second harmonics B′ exhibit 59 dB at 900 Hz, thus revealing slightly reduced distortion of sound.

However, a great improvement still remained to be made for actual use.

SUMMARY OF THE INVENTION

A first object of the present invention is to overcome the drawbacks of the loudspeaker diaphragms produced by the conventional methods described above and to provide a loudspeaker diaphragm having outstanding acoustic characteristics which involves a reduced likelihood of the distortion of harmonics due to abnormal vibration or partial resonance in the range of partial vibration.

To fulfill this object, the invention provides a dome-shaped diaphragm for loudspeakers which comprises a substrate fabric of synthetic fiber, a polyurethane elastomer film adhered to the substrate fabric, and a viscoelastic resin adhesive elastically adhering the film to the substrate fabric.

While the second conventional method described above and the method wherein an adhesive is used as an improvement over the second method were unable to remarkably reduce the distortion of sound, the various experiments we conducted led us to think that the drawback would be attributable to impeded propagation of vibration from the substrate fabric to the polyurethane elastomer film. We further speculated that the cause therefor would be attributable to the direct or rigid bond between the substrate fabric and the polyurethane elastomer film.

Accordingly we conceived of the idea of providing an elastic material between the substrate fabric and the film instead of merely joining them together with heat and pressure or adhereing them together with a mere adhesive. At the same time, we contemplated rendering the two components substantially uniform in thickness and joining them together.

These ideas and further efforts have matured to the foregoing diaphragm which comprises a substrate fabric of synthetic fiber, a polyurethane elastomer film and a viscoelastic resin adhesive.

Since the polyurethane elastomer film is adhered to the substrate fabric of synthetic fiber with the viscoelastic resin adhesive which has elasticity, the fabric and the film can be joined together elastically and reliably, assuring smooth propagation of vibration from the fabric to the film by virtue of the elasticity of the viscoelastic resin adhesive.

FIG. 3 shows the acoustic characteristics of the diaphragm. The drawing reveals that because partial vibration can be mitigated, second harmonics B″ exhibit 50 dB at 900 Hz. In other words, the sound emitted from the diaphragm at 900 Hz involves only about 1/10 the distortion of the conventional diaphragm shown in FIG. 4. Indicated at A'' is sound pressure.

The polyurethane elastomer film not only imparts airtightness to the substrate fabric of synthetic fiber but also serves the function of supplementing the shape retentivity of the synthetic fiber itself at a reduced manufacturing cost.

Further because the polyurethane elastomer film can be of any desired thickness, the flexibility of the diaphragm is easily controllable as required for any of various purposes.

In view of productivity, substrate fabrics of synthetic fibers are specified for use in this invention.

For example, when silk cloth is used as the substrate fabric, phenolic resin is usually used for giving shape retentivity to the cloth. However, if this resin is heat-treated by a commercial operation, the polyurethane elastomer film will melt at the treating temperature.

Accordingly there arises the necessity of shaping the two components together at a lower temperature, or alternatively, subjecting a substrate fabric impregnated with phenolic resin to press work and heat treatment at the same time to obtain a dome-shaped fabric and thereafter joining the polyurethane elastomer film to the fabric by press work at a lower temperature.

The former method is low in production speed, whereas the latter method requires one more production step. In either case, it is impossible to provide loudspeaker diaphragms at a low cost and with outstanding acoustic characteristics.

A second object of the invention is to provide a process for producing the loudspeaker diaphragm described above and having outstanding characteristics.

The process of this invention for producing the loudspeaker diaphragm comprises the first step of forming a layer of viscoelastic resin adhesive over a surface of a polyurethane elastomer film, the second step of adhering together the polyurethane elastomer film and a substrate fabric of synthetic fiber with the adhesive layer interposed therebetween to form a diaphragm base material, and the third step of shaping the base material to the form of a dome with application of heat and pressure.

This process provides a diaphragm for loudspeakers which has the outstanding characteristics already described.

Other objects and advantages of the present invention will become apparent from the following description.

BRIEF DESCRIPTION OF THE DRAWINGS

The drawings show a diaphragm for loudspeakers and a process for producing the diaphragm.

DESCRIPTION OF THE PREFERRED EMBODIMENTS

Figures 1, 2:
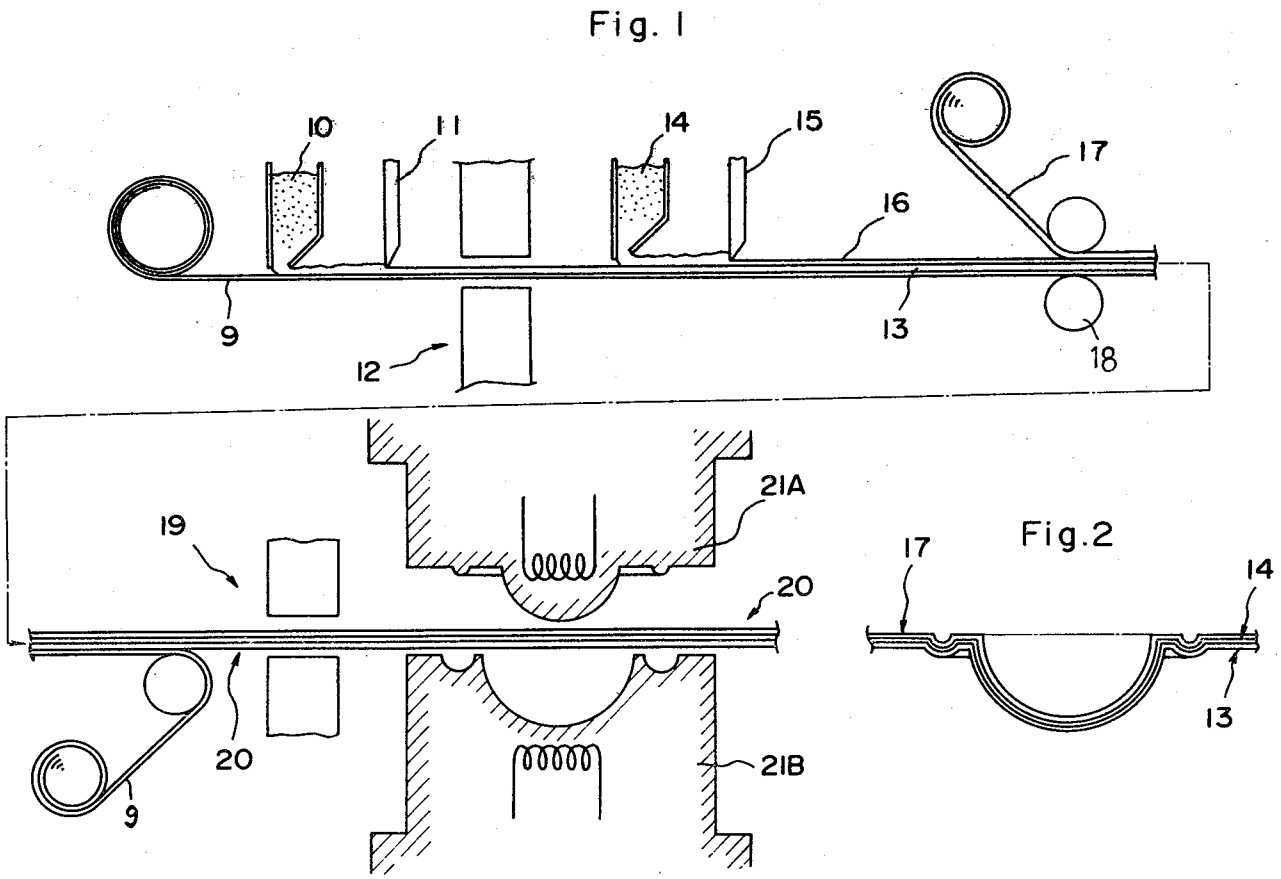
FIG. 1 is a side elevation partly in vertical section and schematically showing the process.
FIG. 2 is an enlarged side elevation in vertical section and showing the loudspeaker diaphragm shaped in the form of a dome.
Figure 3:
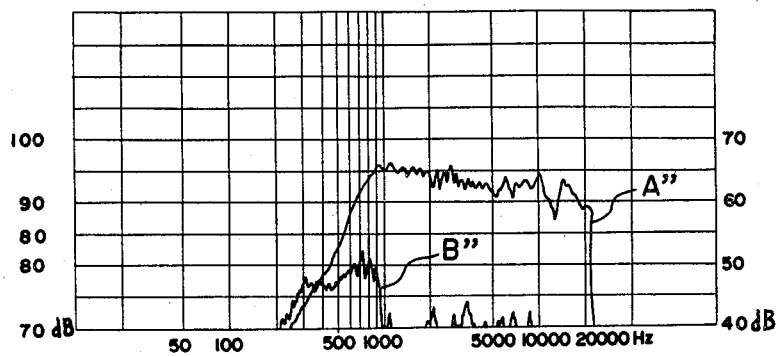
FIG. 3 is a graph showing the acoustic characteristics of the loudspeaker diaphragm of the invention.
Figure 4:
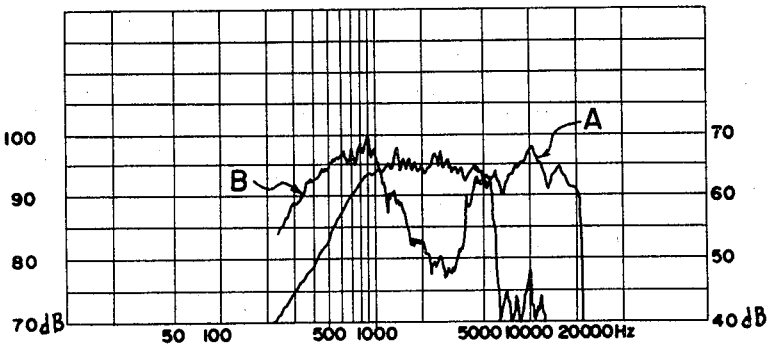
FIG. 4 is a graph showing the acoustic characteristics of a conventional loudspeaker diaphragm.
Figure 5:
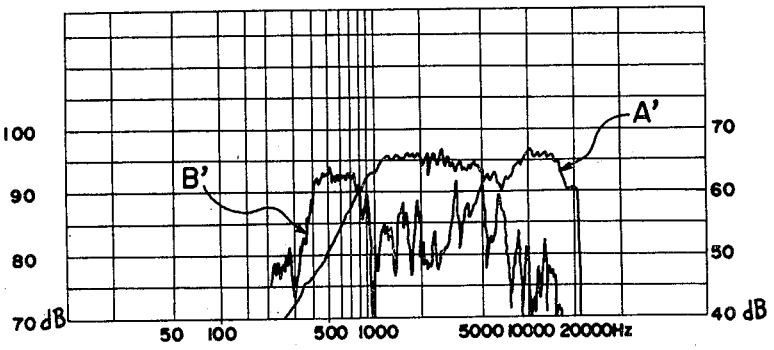
FIG. 5 is a graph showing the acoustic characteristics of an improvement over the conventional diaphragm.

With reference to FIG. 1, a polyurethane elastomer solution (e.g. "Hilac 3090", trade name, product of Toyo Polymer Co., Ltd.) 10 was applied to a surface of release paper 9 while continuously paying off the paper 9 from a roll. The coating was levelled to a uniform thickness by a doctor 11 and thereafter dried by an infrared drier 12 to form on the surface of the paper 9 a polyurethane elastomer film 13 having a thickness of 5 to 35 microns, preferably 20 to 30 microns. The coating was dried at 120° C. for 1 to 1.5 minutes. The coating may be dried spontaneously.

Subsequently a polyurethane adhesive (e.g. "Hilac AD", trade name, product by Toyo Polymer Co., Ltd.) 14 serving as a viscoelastic resin adhesive was applied to the surface of the polyurethane elastomer film 13. The coating was levelled uniformly by a doctor 15 to form an adhesive layer 16 having a thickness of about 5 to 15 microns. A rubber adhesive is usable as the viscoelastic resin adhesive to achieve an equivalent effect.

A substrate fabric 17 which was being continuously paid off from a roll was thereafter placed over the polyurethane elastomer film 13 to interpose the adhesive layer 16 between the fabric 17 and the film 13. The fabric 17 and the film 13 were pressed together by rollers 18, dried by an infrared drier 19 and thereby completely adhered together to form a diaphragm base material 20.

The base material 20 was separated from the release paper 9 before dried by the drier 19.

Before the substrate fabric 17 is adhered to the layer 16 of the adhesive 14, about 30% to 80%, preferably 70% of the amount of the solvent therein has evaporated off. When the fabric 17 is adhered to the film 13, the adhesive 14 partly enters the meshes or openings of the fabric 17 to firmly adhere the fabric to the polyurethane elastomer film 13. The assembly of the fabric 17 and the film 13 was dried by the drier 19 at 120° C. for 1 to 1.5 minutes.

In the present embodiment and FIG. 1, the base material 20 separated from the release paper 9 is continuously fed to dies 21A and 21B for shaping, but it is preferable in view of production efficiency to wind up the base material 20 on a roll once and thereafter feed the material 20 to the dies 21A and 21B for shaping.

To render the product lightweight, the substrate fabric 17 used was a thin woven fabric of coase texture having shapability in itself, such as "SHA No. 733" (trade name, product of Toray Industries, Inc.) This fabric is 0.1 mm in thickness, weighs 31 g/m$^2$ and is made from twisted yarns each composed of six 30-denier polyester filaments by plain-weaving the yarns (100 warps and 89 wefts per inch).

Accordingly the diaphragm base material 20 prepared by laminating the polyurethane elastomer film 13 to the surface of the substrate fabric 17 was 0.12 to 0.13 mm in thickness and 80 g/m$^2$ in weight.

The base material 20 was pressed by the dies 21A and 21B to the form of a dome at a temperature of 170° C. for 20 to 30 seconds, whereby a dome-shaped diaphragm for loudspeakers was obtained as seen in FIG. 2.

Although the step of applying the polyurethane elastomer solution 10 to the release paper 9 has been described above, a polyurethane elastomer film wound on a drum with release paper is alternatively usable. In this case, the polyurethane adhesive 14 is applied to the film as unwound from the drum.

FIG. 2 shows the dome-shaped diaphragm in vertical section. The substrate fabric 17 and the polyurethane elastomer film 13 are elastically adhered together with the polyurethane adhesive 14 interposed therebetween and serving as a viscoelastic resin adhesive.

As the physical properties, the polyurethane elastomer film used in the present invention has Yung's modulus of 1 to $50\times10^8$ dyne/cm$^2$ and Internal loss factor (tan $\delta$) of 0.2 to 0.5. Also, the polyurethan adhesive or the rubber adhesive has Yung's modulus of 0.5 to $50\times10^8$ dyne/cm$^2$ and Internal loss factor (tan $\delta$) of 0.2 to 0.5.

We claim:

1. A dome-shaped diaphragm for loudspeakers comprising:

a substrate fabric (17) of synthetic fiber, a polyurethane elastomer film (13) adhered to the substrate fabric (17), and a viscoelastic resin adhesive (14) elastically adhering the substrate fabric (17) and the film (13) together.

2. A diaphragm as defined in claim 1 wherein the viscoelastic resin adhesive (14) is a polyurethane adhesive.

3. A diaphragm as defined in claim 1 wherein the viscoelastic resin adhesive (14) is a rubber adhesive.

4. A diaphragm as defined in claim 2 wherein the polyurethane elastomer film (13) is 5 to 35 microns in thickness, and the polyurethane adhesive (14) is 5 to 15 microns in thickness.

5. A diaphragm as defined in claim 4 wherein the substrate fabric (17) is a plain weave of polyester.

6. A process for producing a diaphragm for loudspeakers comprising:

the first step of forming a layer (16) of viscoelastic resin adhesive over a surface of a polyurethane elastomer film (13), the second step of adhering together the polyurethane elastomer film (13) and a substrate fabric (17) of synthetic fiber with the adhesive layer (16) interposed therebetween to form a diaphragm base material (20), and the third step of shaping the base material (20) to the form of a dome with application of heat and pressure.

7. A process as defined in claim 6 further comprising the step of forming the polyurethane elastomer film (13) over a surface of release paper (9) prior to the first step.

8. A process as defined in claim 6 wherein the film (13) and the substrate fabric (17) are pressed together by rollers in the second step.

9. A process as defined in claim 8 further comprising the step of drying the diaphragm base material (20) prior to the third step by heating the material (20) in an oven.

10. A process as defined in claim 9 wherein the base material (20) is dried by being heated in the oven having an internal temperature of 80° C. to 120° C. and is shaped in the third step by being heated at 160° C. to 230° C.

* * * * *